US005309595A

United States Patent [19]

Salecker et al.

[11] Patent Number: 5,309,595

[45] Date of Patent: May 10, 1994

[54] DRAIN CLEANING APPARATUS

[75] Inventors: Roy W. Salecker, Mendota; David Margherio, Ladd; Donald Borelli, Mendota; Rockwell T. Sloter, Mendota, all of Ill.

[73] Assignee: Spartan Tool Div. of Pettibone Corp., Mendota, Ill.

[21] Appl. No.: 950,816

[22] Filed: Sep. 24, 1992

[51] Int. Cl.[5] ..... B08B 9/02

[52] U.S. Cl. ..... 15/104.33; 15/257.01

[58] Field of Search ..... 15/104.33, 104.31, 257.01

[56] References Cited

U.S. PATENT DOCUMENTS

| | | | |
|---|---|---|---|
| 3,246,354 | 4/1966 | Cooney et al. | 15/104.33 |
| 3,747,153 | 7/1973 | O'Neill | 15/104.33 |
| 4,364,139 | 12/1982 | Babb et al. | 15/104.33 |
| 5,031,276 | 7/1991 | Babb et al. | 15/104.33 |
| 5,193,242 | 3/1993 | Irwin | 15/104.33 |

*Primary Examiner*—Edward L. Roberts

*Attorney, Agent, or Firm*—Wood, Phillips, VanSanten, Hoffman & Ertel

[57] ABSTRACT

A drain cleaning apparatus has a cylindrical drum containing a supply of flexible line suitable for cleaning a drain. A frame is provided for rotatably supporting the drum and, in addition, the frame mounts a motor for rotating the drum relative to the frame and a control unit for selectively advancing cable from the drum and causing the cable to move back into the drum as the drum and cable length are rotated in use. The apparatus includes a wheeled cart which can be connected to at least one of the frame and drum for releasably operatively connecting the cart and the one of the frame and drum to allow the cart to be used to transport the drum and frame as a unit. Alternatively, the cart is adapted to be releasably connected to the drum to allow the drum to be transported by the cart without the frame.

17 Claims, 2 Drawing Sheets

FIGURE 3
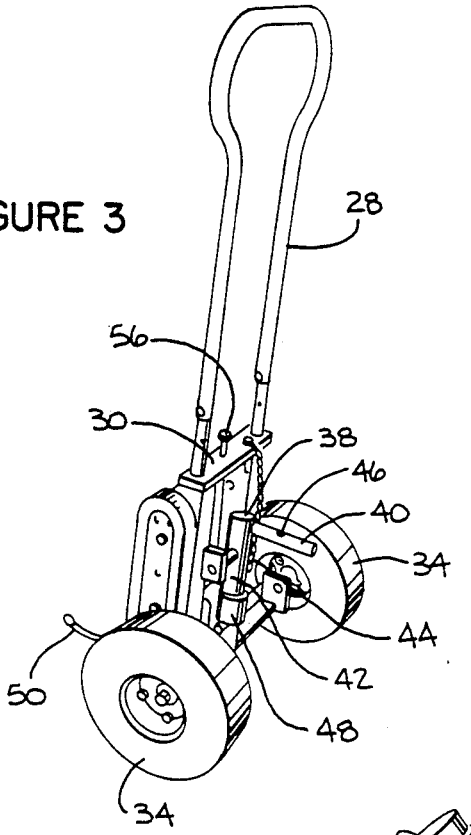
FIGURE 4
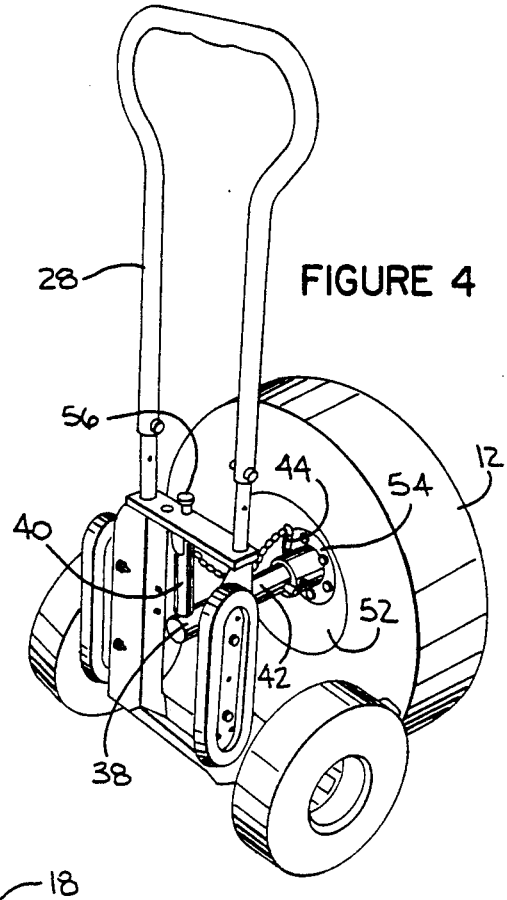
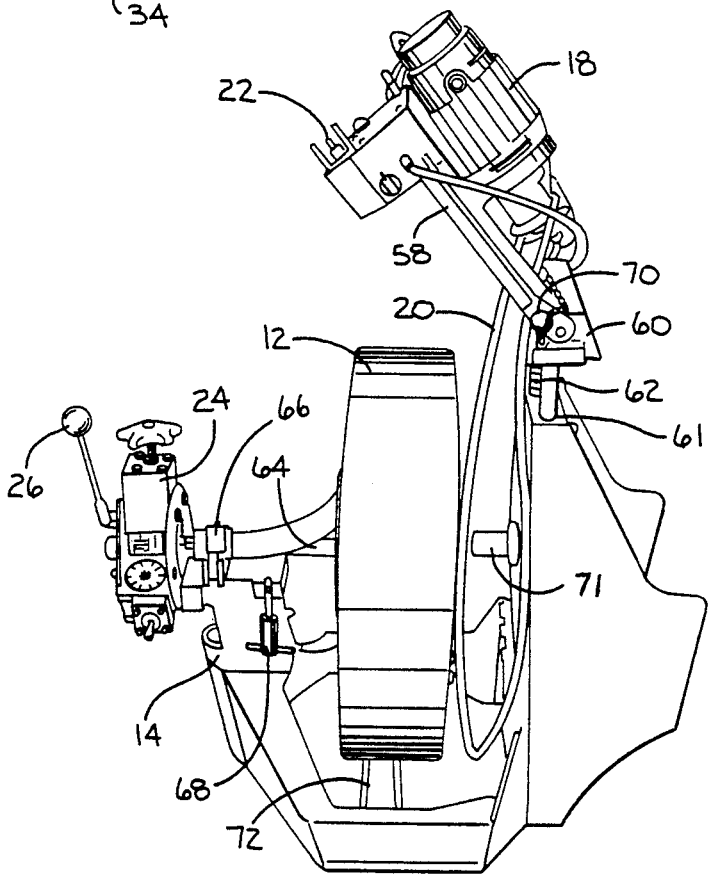
FIGURE 5

DRAIN CLEANING APPARATUS

BACKGROUND OF THE INVENTION

1. Technical Field

The present invention relates to a sewer and drain cleaning apparatus of the type adapted to unwind a cable or snake from a rotary drum and feed the cable through a drain. More particularly, the present invention relates to a drain cleaning apparatus which readily permits lo interchange of rotary drums.

2. Background Art

Drain cleaning machines typically have a rotary drum which contains a coiled cable or snake. To clean a drain, the drum is rotated and a length of cable is advanced by a control from the drum and fed through the drain to clear an obstruction. An exemplary cable control is disclosed in U.S. Pat. No. 3,394,599, issued Jul. 30 1968, and owned by the assignee hereof. After the drain is opened, the cable is withdrawn from the drain and wound back into the drum. A drain cleaning machine may have 125 feet of cable and can weigh more than 300 pounds, with the weight of the cable and the drum accounting for than one-half of the total machine weight. Due to their substantial weight, drain cleaning machines sometimes have a wheeled frame for transporting the machine to and from a job site.

When, in the course of cleaning a drain, the entire length of cable is drawn from the drum and fed into a drain without reaching the obstruction, additional cable must be attached to the trailing end of the original cable and fed through the drain.

One approach to increasing the length of a cable is to manually load a new cable into an emptied drum and attach the free end of the new cable to the trailing end of the original cable. Feeding of the lengthened cable into the drain then is resumed. The problem with reloading a drum, in addition to the unacceptable amount of time required and the inconvenience of transporting a cable to the job site, is that upon clearing the obstruction, the entire loading procedure must be repeated in reverse when the cable is withdrawn from a drain to permit the original cable to fit within the drum.

Some drain cleaning machines have a removable drum. When the entire length of the cable is drawn from the original drum and it is desired to increase the cable length, the cable is disconnected from the drum and the original drum is replaced with a second, preloaded drum. The original cable then is connected to the new cable and operation is resumed.

Removable drums also are used to facilitate the interchange of different sizes of cables on a drain cleaning machine. That is, when the gauge or length of a cable on a drain cleaning machine is unacceptable for a particular drain cleaning application, the original drum and cable are removed from the machine and replaced with a drum which contains a cable having a suitable size. By maintaining a supply of replacement drums each of which are preloaded with a different size of cable, the proper size cable easily and rapidly can be installed on a drain cleaning machine.

The problem with drain cleaning machines which have a removable drum is the difficulty in safely handling the weight of the drum and a cable. When increasing the length of a cable, the emptied drum first must be dismounted and transported from the machine. The replacement drum and cable then must be transported to the already positioned machine and mounted thereon. To change the size of a cable, the loaded original drum must be dismounted and the replacement drum and cable must be delivered and mounted on the machine. Due to the weight and generally cumbersome nature of a drum and a cable, removal and replacement of a drum requires a considerable amount of time and heavy lifting. Consequently, the need exists for a drain cleaning machine that facilitates the interchange of a rotary drum and cable.

SUMMARY OF THE INVENTION

It is an object of the present invention, therefore, to provide an improved rotary drain cleaning apparatus designed to facilitate removal of a rotary drum and delivery and installation of a replacement drum.

An exemplary drain cleaning apparatus has a generally cylindrical drum containing a supply of flexible line suitable for cleaning a drain. A frame is provided for rotatably supporting the drum and, in addition, mounts a motor for rotating the drum relative to the frame and a control unit for selectively advancing cable from the drum and causing the cable to move back into the drum as the drum and cable length are rotated in use. The apparatus includes a wheeled cart which can be connected to at least one of the frame and drum for releasably operatively connecting the cart and the one of the frame and drum to allow the cart to be used to transport the drum and frame as a unit. Alternatively, the cart is adapted to be releasably connected to the drum to allow the drum to be transported by the cart without the frame.

The cart has an upright handle and a movable base for supporting the drum and the frame. A generally L-shaped coupling is pivoted to the cart and has a pair of mutually perpendicular legs. The coupling is rotatable between a first position in which one of the legs is engageable with the frame, and a second position in which the other of the legs is engageable with a drum individually when the cart is used to retrieve a replacement drum.

An elongate bearing shaft on the frame is received in a rearwardly facing axial opening on the drum. The drum also has a forwardly extending axle shaft journaled on the frame.

A motor is attached to a pivot arm on the frame and thereby is movable between an operative position in which the motor is effective to rotate the drum through a belt drive connection and an inoperative position spaced from the operative position to facilitate replacement of the drum. A biasing spring is interposed between the pivot arm and the frame to urge the motor away from the drum and maintain tension in the drive belt.

The drum is detached from the apparatus by urging the drum axially from the bearing shaft. A support bar on the frame receives a drum which is detached from, or which is to be mounted on, the bearing shaft. The support bar is positioned to support a drum coaxially with the bearing shaft, whereby the drum is not required to be lowered from or lifted onto the bearing shaft. The support bar has a ramped surface by which a detached drum can be rolled from the apparatus and by which a replacement drum can be rolled onto the support bar prior to mounting on the bearing shaft.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and advantages, may be best understood by reference to the following description taken in conjunction with the accompanying drawings, in which like reference numerals identify like elements in the figures and in which:

FIG. 3 is a perspective view of the cart detached from the frame assembly and drum;

FIG. 4 is a perspective view of the cart engaged with a drum for transportation thereof apart from the frame; and FIG. 5 is a perspective view showing a motor for rotating the drum in a raised, inoperative position and with the cart detached from the frame assembly.

DETAILED DESCRIPTION OF THE INVENTION

Figure 1:
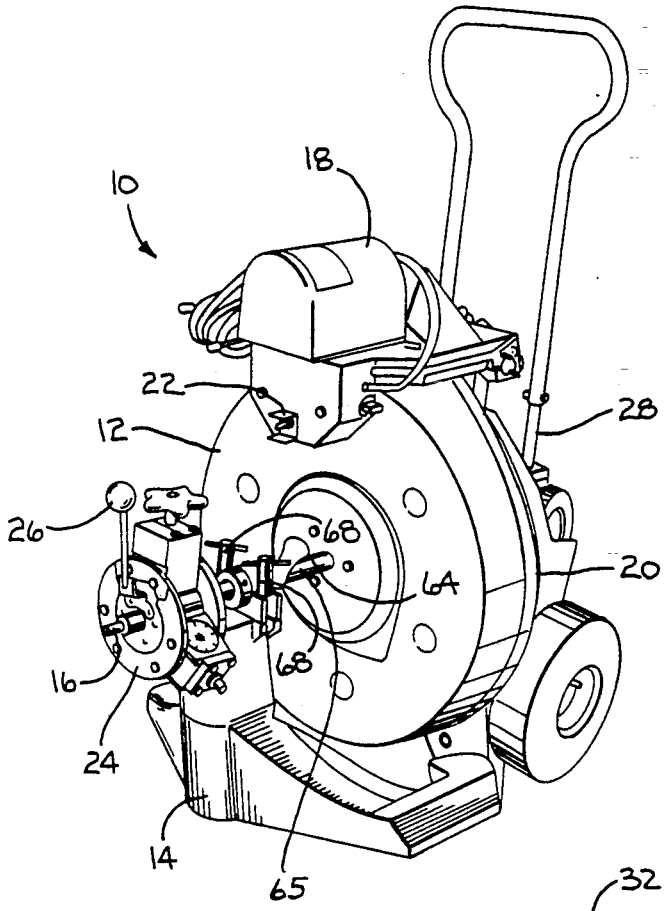
FIG. 1 is a perspective view of the front and left side of a drain cleaning apparatus according to the present invention including a frame assembly carrying a rotatable drum and supported on a wheeled cart.

Referring first to FIG. 1, a rotary drain/sewer cleaning apparatus, generally designated 10, has a belt driven drum 12 mounted for rotation on a frame assembly 14 and preloaded with a supply of coiled line or cable 16 suitable for cleaning a drain.

An electric motor 18 is mounted on the frame assembly 14 and has an associated drive belt 20 for rotating the drum 12 and a control switch 22 for selectively commanding forward and reverse rotation of the motor 18 and drive belt 20. When the drum 12 is rotated, cable 16 is drawn from the drum 12 and advanced toward a drain or, alternatively, is withdrawn from a drain and returned to drum 12 by means of a bi-directional control unit 24. Control unit 24 is of the character disclosed in the aforesaid Tucker U.S. Pat. No. 3,394,599, issued Jul. 30, 1968, and incorporated herein by reference. The cable control unit 24 is mounted on the frame assembly 14 and has a manually positionable selector lever 26 for prescribing the direction in which cable is fed when the drum 12 is rotated. A wheeled cart 28 is attached to the frame assembly 14 and can be manually operated to transport the frame assembly 14 and the drum 12 to a job site.

Figure 2:
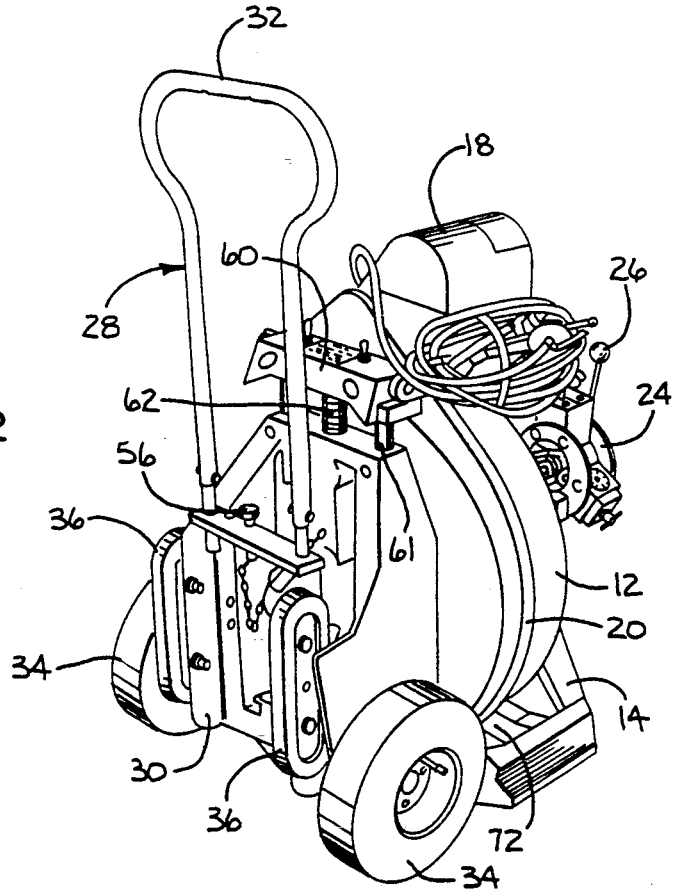
FIG. 2 is a perspective view of the rear and right side of the drain cleaning apparatus.

Referring also to FIG. 2, the cart 28 has a base 30 for supporting the frame assembly 14 and the drum 12. An upright handle 32 extends from the base 30. A pair of axially aligned wheels 34 are provided on the base 30 whereby the cart 28 may be tilted and the drain cleaning apparatus 10 rolled to a desired location. Rotary stair-climbing trucks 36 are attached to the cart base 30 to facilitate transportation of the drain cleaning apparatus 10 up and down stairs.

It is believed that the manner in which drain cleaning apparatus 10 is operated to clear an obstruction from a drain or sewer can be understood from the foregoing description and may be summarized as follows.

Initially, the drain cleaning apparatus 10 is transported to a job site by means of the wheeled cart 28. The electric motor 18 then is energized to rotate the drum 12 and selector lever 26 is positioned such that control unit 24 draws cable 16 from the rotating drum and advances the cable 16 into a drain to be cleaned. Once the drain is opened, selector lever 26 is positioned such that the control unit 24 withdraws the cable 16 from the drain and rewinds the cable 16 into the rotating drum 12.

When the length of cable 16 contained in the drum 12 is insufficient to reach an obstruction it is useful to be able to increase the length of the cable 16 without withdrawing the cable 16 from the drain. Accordingly, it is an object of the present invention to facilitate the removal and replacement of a drum when the supply of cable is depleted. Further, the present invention is adapted to facilitate the removal of a loaded drum and replacement thereof with a drum which contains a different size cable. Moreover, as will be understood from the following discussion, the cart 26 is uniquely capable of detaching from the frame assembly 14 and transporting a replacement drum without moving the frame assembly.

A more detailed view of the wheeled cart 28 is shown in FIG. 3 wherein the cart is shown detached from the frame assembly 14.

The cart 28 has a generally L-shaped coupling member 38 pivoted to the cart base 30. The coupling member 38 can be connected to either the frame assembly 14 when drain cleaning apparatus lo is moved as a unit, or, alternatively, can be connected to the drum 12 to transport a drum independently of the frame assembly 14.

More specifically, coupling member 38 has a pair of mutually perpendicular legs 40 and 42. In the position shown in FIG. 3, that is, with leg 40 extending transversely to the handle 32, the leg 40 is receivable in an opening (or lift hole) in the back of frame assembly 14 to lift and support the frame assembly 14 and drum 12 during transportation of the drain cleaning apparatus 10. After leg 40 is inserted into the frame assembly 14, a locking pin 44 is engaged with the frame assembly 14 and is received in a hole 46 on the leg 40 to prevent separation of the frame assembly 14 and cart 12. A sliding lock 48 on the leg 42 is releasably coupled with the cart base 30 and constrains movement of the coupling member 38. The cart base 30 has a pivot stand 50 to allow free standing of the cart alone.

The drum 12 has a rearwardly opening axial recess 52 (see FIG. 4) with an internally mounted drum support 54. Prior to the cart 28 engaging the drum 12, sliding lock 48 is manually released and the coupling member 38 is rotated into the position shown in FIG. 4 A lift pin lock 56 on the base 30 is engaged with the upright leg 40 to secure the coupling member 38.

Once coupling member 38 is locked in place, the cart 28 is advanced toward the drum 12 and the leg 42 is guided into the drum support 54 in the recess 52. The locking pin 44 is inserted through aligned openings in the drum support 54 and the leg 42 to prevent separation of the two components.

As may be noted from FIGS. 3 and 4, the coupling member 38 is pivoted on the cart 28 about a point lying along the leg 42. As a result, the distance between the leg 40 and the surface on which the wheels 34 are supported is different from the distance between the leg 42 and the surface on which the wheels 34 are supported when the leg 42 extends transversely from the cart. Consequently, the lifting hole on frame assembly 14 is not required to be at the same height as the axial opening in drum support 54 and, instead, can be positioned so as to adequately balance the weight of the frame assembly and drum when the leg 40 is received in the lifting hole.

Referring now to FIG. 5, the electric drive motor 18 is attached to the frame assembly 14 by a rotatable swing arm 58. The swing arm 58 is pivoted to a reciprocable slide 60 which, in turn, is guided for substantially vertical movement through openings 61 in the frame assembly 14. A compression spring 62 is interposed between the slide 60 and the frame assembly 14 to urge the motor 18 away from the drum 12 and thereby maintain tension in the drive belt 20.

Frame assembly 14 has an elongate bearing shaft 64 for rotatably mounting the drum 12 and supporting the weight of the drum and the cable contained therein. An integral axle shaft 65 extends forwardly from the drum 12 and is journaled on the frame assembly 14 by means of a bearing block 66. The bearing block 66 is releasably secured to the frame assembly by a pair of swing bolts 68.

To remove a drum from the frame assembly 14, the slide member 60 is depressed to relieve tension in the drive belt 20 and the belt then is slipped off the drum. The motor 18 then is rotated to the inoperative position shown in FIG. 5 and a locking pull pin 70 is inserted through aligned openings in the swing arm 58 and the slide 60 to maintain the motor in a raised position.

After disengaging the swing bolts 68 from frame assembly 14, the drum 12 is shifted axially along bearing shaft 71 and is received on a support bar 72 on the base of frame assembly 14. Once the bearing shaft is fully disengaged from drum support 54, the drum 12 is rolled off the support bar 72 and can be replaced. Return of the empty drum and retrieval of a new, preloaded drum is accomplished with the cart 28 as described above. Installation of a new drum 12 on the drain cleaning apparatus 10 is performed by repeating the above procedure in reverse.

Support bar 72 advantageously is adapted to facilitate removal and replacement of a drum 12 from frame assembly 14. More particularly, the support bar is constructed such that when a drum 12 is positioned on the support bar, the drum support 54 is coaxial with the bearing shaft 62 and the drum need not be lifted or dropped to be mounted on or detached from the bearing shaft. In addition, and as best shown in FIG. 2, the outboard ends of support bar 72 are downwardly sloped whereby a drum 12 can easily be rolled on or off the frame assembly 14.

It will be understood that the invention may be embodied in other specific forms without departing from the spirit oı central characteristics thereof. The present examples and embodiments, therefore, are to be considered in all respects as illustrative and not restrictive, and the invention is not to be limited to the details given herein.

We claim:

1. A drain cleaning apparatus comprising:

a drum containing a supply of flexible line suitable for cleaning a drain;

a frame;

means cooperating between the frame and the drum for removably mounting the drum in an operative position on the frame for rotation relative to the frame, whereby a length of the cable projecting from the drum can be engaged by a control means to selectively advance the cable from the drum and cause the cable to move back into the drum as the drum and cable length are rotated in use;

a cart; and means for selectively releasably connecting the cart and the frame so as to a) allow the cart to be used to transport the drum and frame as a unit in an operative position and b) allow the cart to be detached from the frame to allow the connecting means to be used to transport at least one of a different frame and a drum.

2. A drain cleaning apparatus comprising:

a drum containing a supply of flexible line suitable for cleaning a drain;

a frame;

means cooperating between the frame and the drum for removably mounting the drum in an operative position on the frame for rotation relative to the frame, whereby a length of the cable projecting from the drum can be engaged by a control means to selectively advance the cable from the drum and cause the cable to move back into the drum as the drum and cable length are rotated in use;

means cooperating between the cart and at least one of the frame and drum for releasably operatively connecting the cart and the one of the frame and drum to allow the cart to be used to transport the drum and frame as a unit; and means cooperating between the cart and the drum for releasably connecting the drum to the cart to allow the drum to be transported by the cart without the frame.

3. The apparatus of claim 2 in which the cart has a coupling member selectively movable between a first position in which the coupling member is engageable with the frame and a second position in which the coupling member is engageable with the drum.

4. The apparatus of claim 3 in which the coupling member is generally L-shaped and has a pair of mutually perpendicular legs, a first one of the legs being engageable with the frame when the coupling member is in the first position and a second one of the legs being engageable with the drum when the coupling member is in the second position.

5. The apparatus of claim 4 in which the coupling member is pivoted about a point lying on one of the legs such that when the coupling member is in the first position the distance between the first one of the legs and the surface on which the apparatus is supported is different from the distance between the second one of the legs and the surface on which the apparatus is supported when the coupling member is in the second position.

6. A drain cleaning apparatus comprising:

a drum containing a supply of flexible line suitable for cleaning a drain and defining an axis;

a frame;

bearing means cooperating between the frame and the drum and axially engageable with the drum for removably mounting the drum for rotation relative to the frame when the drum is in an operative position, whereby a length of the cable projecting from the drum can be engaged by a control means to selectively advance the cable from the drum and cause the cable to move back into the drum as the drum and cable length are rotated in use;

a cart;

interchange means operatively associated with the frame for facilitating installation and replacement of a drum in operative position; and a coupling member on the cart selectively movable between a first position in which the coupling member is engageable with the frame and a second position in which the coupling member is engageable with a drum for selectively releasably connecting the cart and the frame so as to a) allow the cart to be used to transport the drum and frame as a unit in an operative position and b) allow the cart to be detached from the frame to allow the coupling member to be used to transport at least one of a different frame and a drum.

7. A drain cleaning apparatus comprising:

a drum containing a supply of flexible line suitable for cleaning a drain and defining an axis;

a frame;

bearing means cooperating between the frame and the drum and axially engageable with the drum for removably mounting the drum for rotation relative to the frame when the drum is in an operative position, whereby a length of the cable projecting from the drum can be engaged by a control means to selectively advance the cable from the drum and cause the cable to move back into the drum as the drum and cable length are rotated in use;

interchange means operatively associated with the frame for facilitating installation and replacement of a drum in the operative position;

a cart and means cooperating between the cart and at least one of the frame and the drum for releasably operatively connecting the cart and the one of the frame and drum to allow the cart to be used to transport the drum and frame as a unit; and means cooperating between the cart and the drum for releasably connecting the drum to the cart to allow the drum to be transported by the cart without the frame.

8. The apparatus of claim 7 in which a motor is mounted to the frame and is movable thereon between a first position in which the motor is effective to rotate the drum relative to the frame and a second position spaced from the first position to facilitate installation and replacement of the drum.

9. The apparatus of claim 8 in which the motor has a drive belt connectable with the drum and in which a spring is interposed between the motor and the frame to bias the motor away from the drum and thereby maintain tension in the drive belt when the drum is in the operative position.

10. The apparatus of claim 7, including a cart and means cooperating between the cart and at least one of the frame and the drum for releasably operatively connecting the cart and the one of the frame and drum to allow the cart to be used to transport the drum and frame as a unit.

11. The apparatus of claim 7 in which the interchange means comprises an integral surface adapted t support a drum received thereon in coaxial alignment with said bearing means.

12. The apparatus of claim 7 in which the interchange means comprises a ramp for facilitating a drum to be rolled onto and off of the frame.

13. In a drain cleaning apparatus having a drum containing a supply of flexible line suitable for cleaning a drain and a frame for rotatably supporting the drum and including means for advancing line therefrom, the drum being removably mounted on the frame such that the drum can be interchanged with a replacement drum, a cart for selectively transporting the drum and frame as a unit and transporting a drum without the frame, the cart comprising:

a base having means for enabling the cart to be easily moved along a subjacent surface;

an upright handle extending from the base; and a coupling member movable between a first position for releasably operatively connecting the cart and at least one of the frame and drum to allow the cart to be used to transport the drum and frame as a unit, and a second position for releasably operatively connecting the cart to the drum to allow the drum to be transported by the cart without the frame.

14. The cart of claim 13 in which the coupling member is generally L-shaped and has a pair of mutually perpendicular legs, a first one of the legs being engageable with the frame when the coupling member is in the first position and a second one of the legs being engageable with the drum when the coupling member is in the second position.

15. The cart of claim 14 in which the first one of the legs lies within a first substantially horizontal plane when the coupling member is in the first position and the second one of the legs lies within a second substantially horizontal plane when the coupling member is in the second position, the coupling member being pivoted for rotation in a vertical plane about a point lying on one of the legs whereby said first substantially horizontal plane is vertically offset from said second substantially horizontal plane.

16. The cart of claim 13 in which the base has roller means for facilitating transport of the apparatus on stairs.

17. The cart of claim 13, including means for selectively locking the coupling member in the first position and the second position.

* * * * *